US005735091A

United States Patent [19]

Hawkins et al.

[11] Patent Number: 5,735,091

[45] Date of Patent: Apr. 7, 1998

[54] ROOF DRAIN

[75] Inventors: Robert Hawkins; James Gordon, both of Mississauga; Thomas Marshall, Georgetown, all of Canada

[73] Assignee: National Roofing Supply, a div. of A.C.T. Marketing Inc., Mississauga, Canada

[21] Appl. No.: 618,530

[22] Filed: Mar. 19, 1996

[51] Int. Cl.[6] ..... E04B 1/66

[52] U.S. Cl. ..... 52/302.7; 52/302.1; 52/198; 52/302.6

[58] Field of Search ..... 52/198, 302.6, 52/302.1, 302.7; 210/162, 163–166

[56] References Cited

U.S. PATENT DOCUMENTS 3,357,561 12/1967 Schmid et al. ..... 52/12 X
5,237,789 8/1993 Thaler ..... 52/199 X
5,458,769 10/1995 Johannessen ..... 52/12 X
5,469,670 11/1995 Thaler ..... 210/163 X
5,522,197 6/1996 Ebeling ..... 52/302.1 X
5,526,613 6/1996 Simeone, Jr. ..... 52/302.1 X

*Primary Examiner*—Carl D. Friedman
*Assistant Examiner*—W. Glenn Edwards

[57] ABSTRACT

An improved roof drain having a wide flange, a base, and a means to secure attachments such as strainers to the base. The attachment means is characterized by being simple and permanent. In one embodiment, the strainer contains a peripheral flange which is rolled-into the large horizontal flange of the base during fabrication. Other attachments such as gravel stops and the like may be attached in a similar fashion. The base is an integral piece typically made from spun aluminum. An alternative embodiment includes a two-part generally annular clamping ring, the lower portion of which includes integral threaded studs. The lower portion of the clamping ring is permanently attached to the base again by being rolled into the large flange on the base.

8 Claims, 7 Drawing Sheets

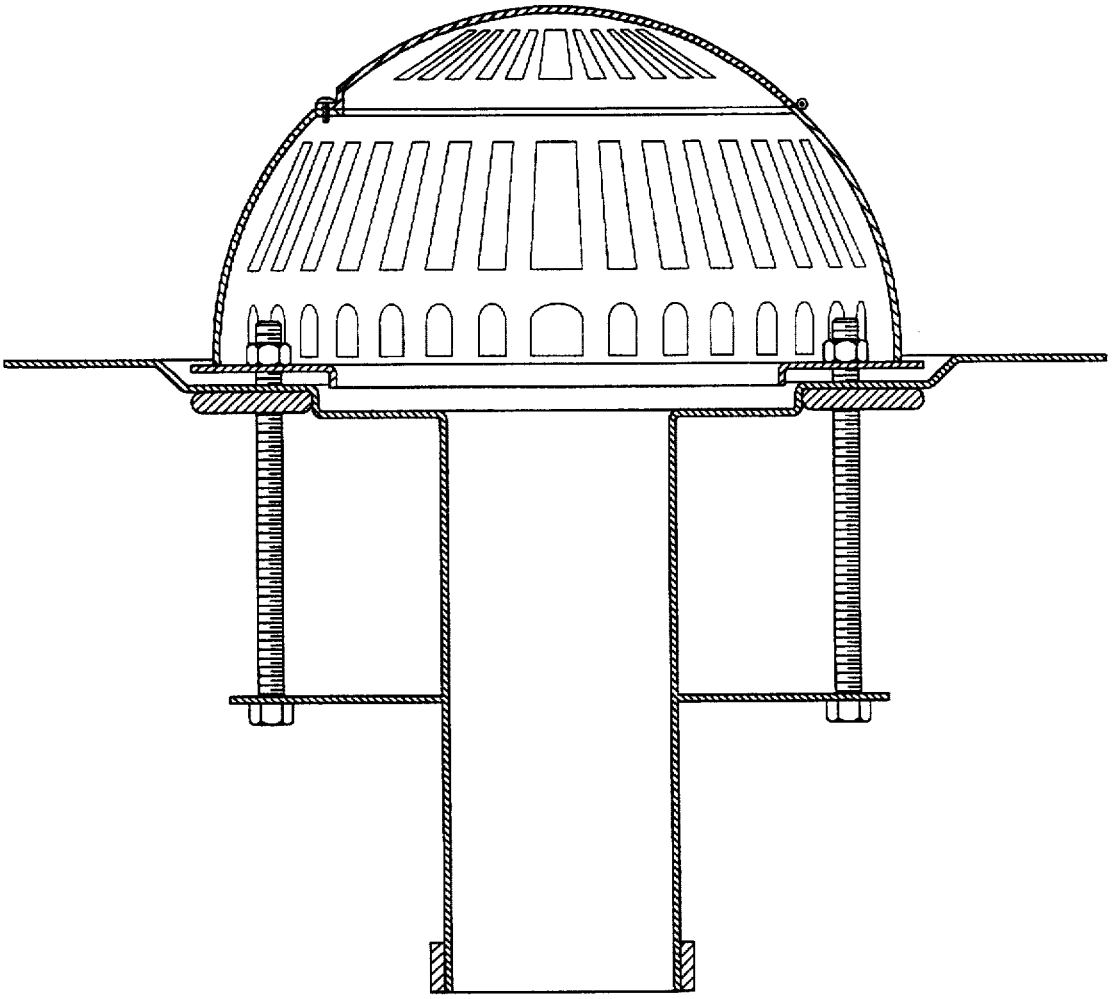
FIG.1A (PriorArt)

ROOF DRAIN

BACKGROUND OF THE INVENTION

This invention relates to roof drains for commercial and industrial applications. In particular, the roof drain is designed to be a durable, cost-effective product by providing an improved way of securing attachments, such as strainers, to the top of the drains. The drain has a simple yet effective design, thereby providing the required protection at a reasonable cost.

FIG. 1A depicts a prior art device. This device includes a cast iron strainer secured to the base by means of bolts passing through the roof deck. In the tube portion of the base there is attached a clamp which supports the bolts. In addition there is a heavy ring-shaped clamp which is secured adjacent to the flange in the base. This is a complicated and expensive method of securing a strainer or other body attachment.

FIG. 1B depicts another prior art device using threaded bolts braized or welded into the flange portion of the base. These upwardly extending bolts are used to secure the strainer. They are prone to being snapped off however.

FIG. 1C depicts an additional prior art device again using the "through-bolting" method of securing a strainer. The bolts are fastened to a supporting ring and extend upwardly through the roof deck and then through a ring-shaped plate. Finally, they are secured to the strainer.

All of these prior art methods of securing strainers are either unnecessarily complex or suffer from durability problems.

SUMMARY OF THE INVENTION

The roof drain includes an integrally formed body having a water collecting section, and a large flange comprising a first horizontal body surface and a second horizontal body surface both connected by a connecting surface. The body is adapted to be attached to a drain pipe on the roof of a building via a tube portion. On top of the body can be secured one or more various body attachments including strainers, gravel stops, ballast collars, control flow collars, and the like. The method of securing these body attachments is by rolling-in a peripheral flange on the body attachment into the large flange on the body of the drain. This permanent method of connection reduces the incidence of lost strainers (or other attachments) due to extreme weather, tampering or vandalism.

Another embodiment of the drain is provided which includes a two-part clamping ring. In this embodiment the lower ring is permanently attached to the body, again by having it rolled in to the large flange on the body section. The lower ring includes a plurality of permanently attached, upward projecting threaded studs used to secure the upper ring and the lower ring together. Other desired body attachments can also be secured using the clamping ring.

BRIEF DESCRIPTION OF THE DRAWINGS

In order that the invention may be more clearly understood, the preferred embodiment thereof will now be described in detail by way of example, with reference to the accompanying drawings, in which:

FIG. 1A is a prior art device using pass through bolts;

DETAILED DESCRIPTION OF THE PREFERRED EMBODIMENT

Figure 1B:
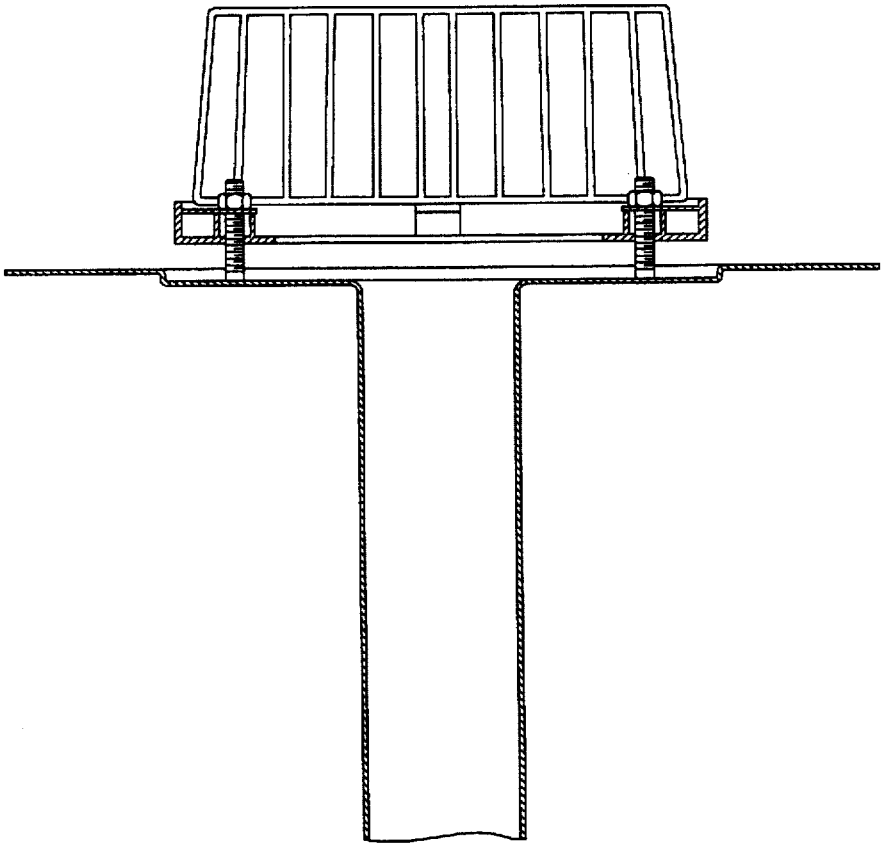
FIG.1B (Prior Art)
FIG. 1B is a prior art device using studs attached to flange.
Figure 1C:
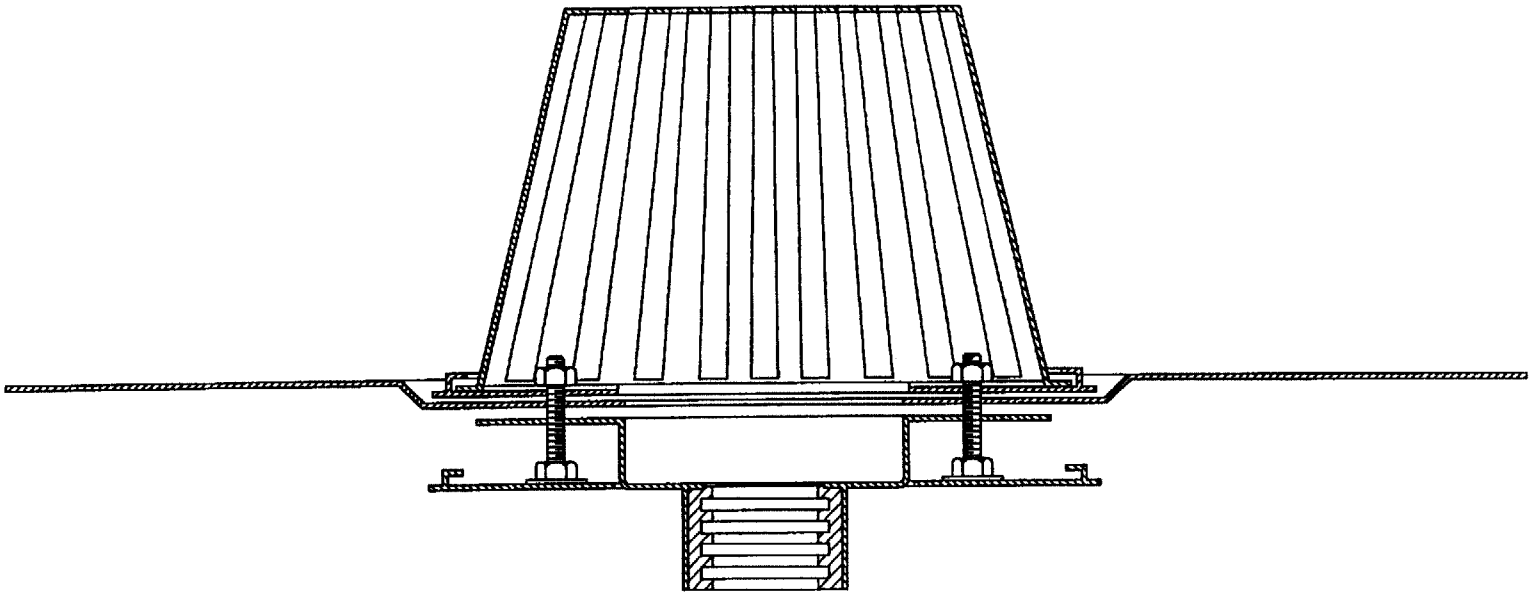
FIG.1C (Prior Art)
FIG. 1C is another prior art device using pass through bolts.
Figure 2:
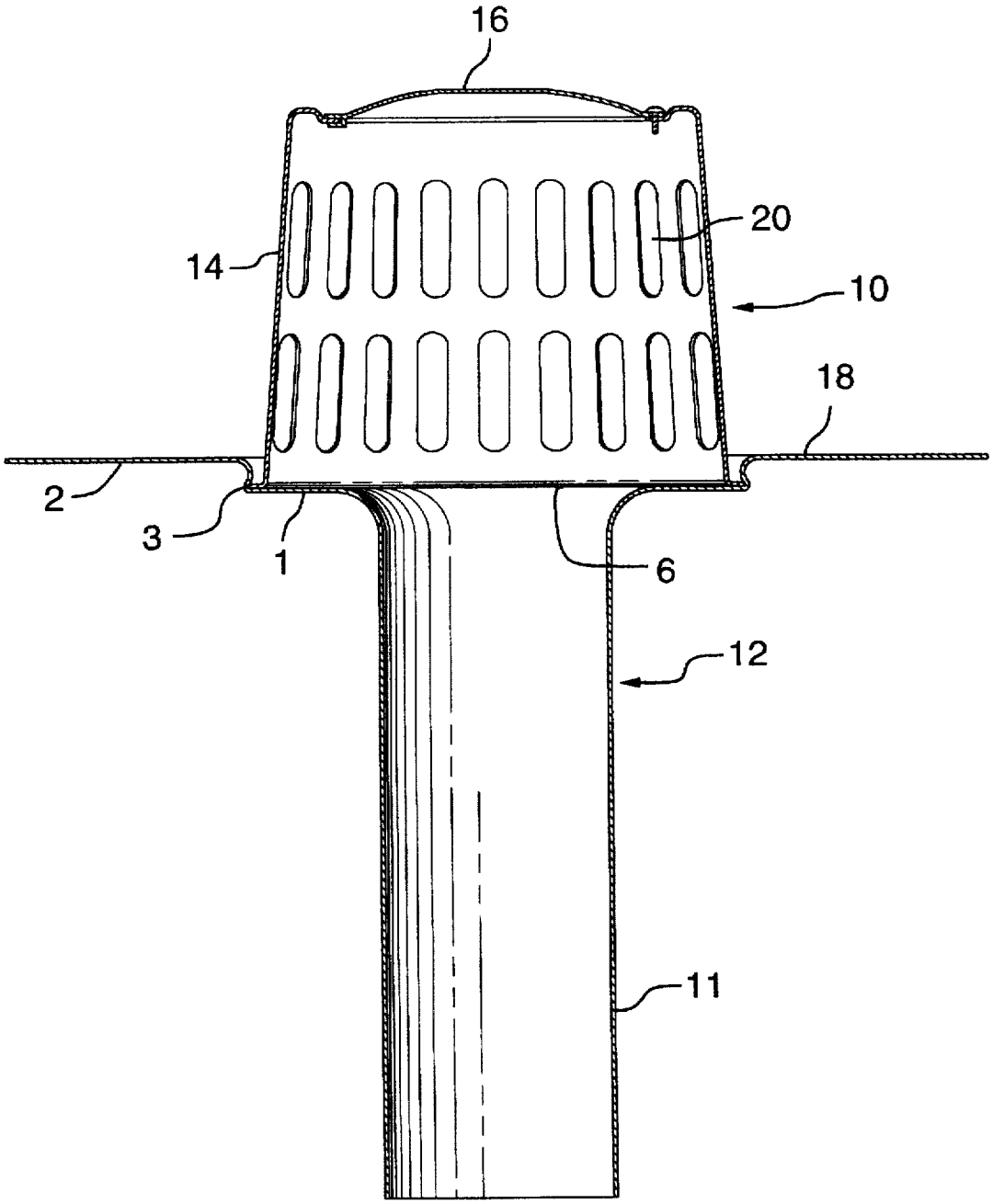
FIG. 2 is a side cross-sectional view of the roof drain.

Referring now to FIG. 1, the drain 10 of the present invention can be seen. The drain comprises a body or base 12, a strainer 14, and a removable cap 16 as its main components. The base has a lower cylindrically-shaped tube portion 11 and an upper generally horizontal annular-shaped flange portion 18. A funnel shaped water collecting section joins the tube and flange portion. The flange portion 18 consists of a first inner body surface 1, and a second body surface 2 located outwardly of the first body surface. A connecting surface 3 joins said first and second said body surfaces, both body surfaces being generally horizontal.

Figure 3:
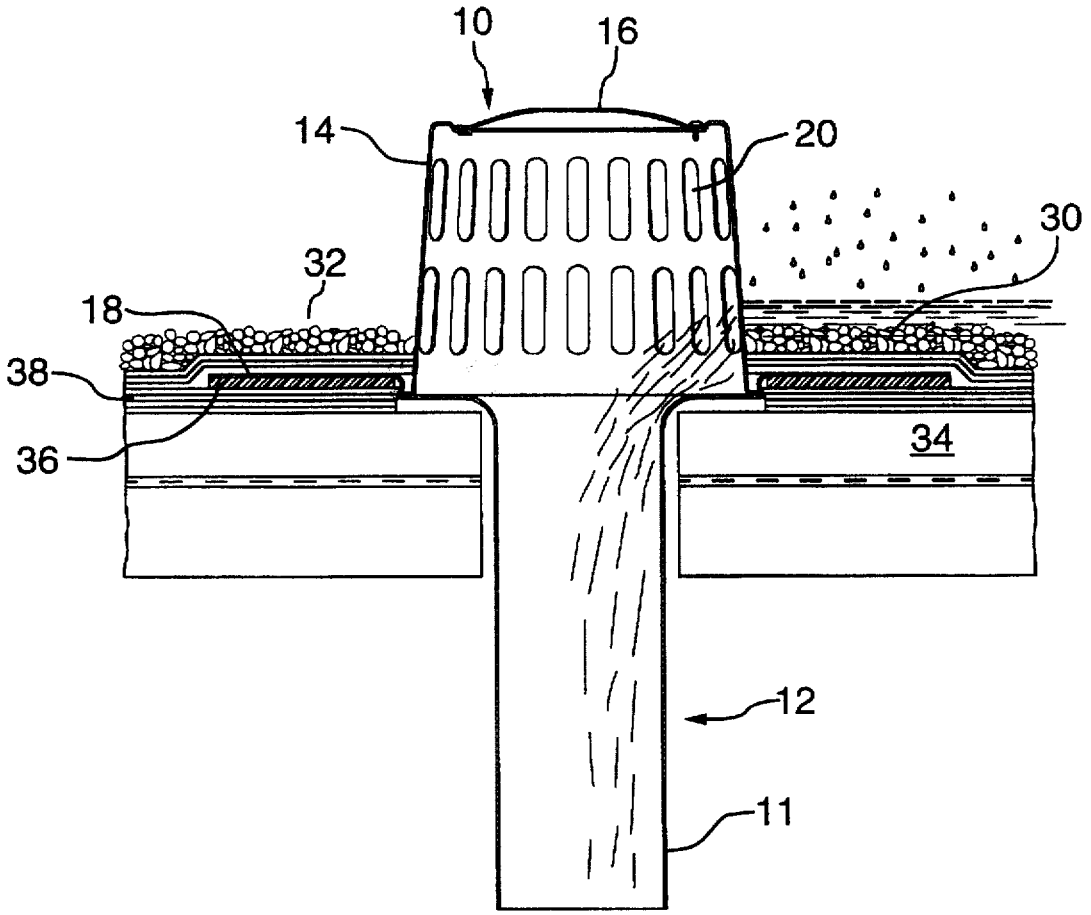
FIG. 3 is a side cross-sectional view of the roof drain as installed on a roof.

Referring now to FIG. 3, the drain 10 can be seen installed in a typical fashion. The tube portion of the base 11 extends downwardly from the surface of the roof to attach to a drain pipe (not shown). Once installed, the flange 18 is located approximately level with the top surface of the roof and is secured using a suitable means, such as plastic cement 36. The second outer body surface of the flange 2 is typically covered in plies of layered felt 38. The main roof structure 34 is covered firstly with plies of layered felt 38 and then is additionally covered with roofing gravel or aggregate 32. Water that falls on the roof 30 can enter the drain through holes 20 in strainer 14. Holes 20 are sized and shaped to permit water to enter the drain and to restrict debris and or roof gravel from doing so. The water then passes into the inner water collecting portion of the drain and ultimately into the tube section of the drain and is then discharged from the roof through the roof pipe (not shown).

Figure 5:
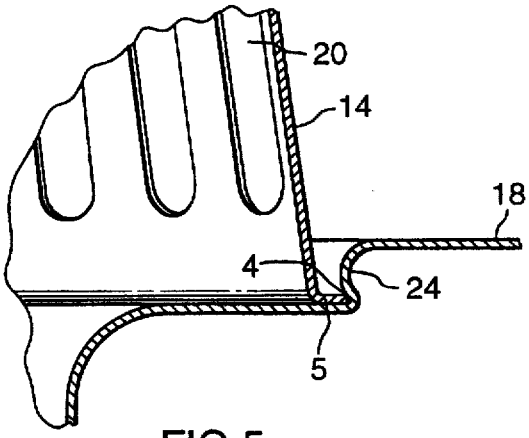
FIG. 5 is an expanded cross-sectional view of the strainer retaining means.

Referring now to FIG. 5, an enlarged view of the connection between the strainer 14 and the body 12 is shown. In this embodiment the body 12 is integrally formed from spun aluminum, although other methods can be used. The first body surface 1 is generally annular in shape extending from an upper opening 6 to the tube section 11 outwardly to the connecting surface 3. The second body surface 2 is disposed outwardly from first said horizontal surface 1. The connecting surface 3 joins the two body surfaces.

In the preferred embodiment shown second body surface 2 is also located upwardly of first body surface 1. This configuration reduces any ponding or pooling of water near the edge of the drain. In manufacturing this is also the easiest configuration to work with when securing a body attachment as described below.

To cover the opening to the drain 10, one embodiment includes a self-supporting strainer 14 which is generally dome-shaped as is well known in the art. The strainer is provided with an outwardly-directed peripheral flange 5 on its lower edge. The outside diameter of this flange is sized and configured to mate with the first body surface 1 of the body 12.

During fabrication the self-supporting strainer 14 is placed in the centre the first body surface 1 and is then "rolled-in" thereby forming the second body surface 2, and the connecting surface 3, which includes a shoulder 24. This "rolling-in" process results in a recess 4 being formed at the edge of the first body surface, into which recess the peripheral flange 5 on the strainer 14 is secured. This method of attachment is permanent.

In a similar fashion, it is possible to have other body attachments secured by the same process. During fabrication the strainer and possibly another attachments such as a gravel stop, control flow collar etc. (not shown) might both be placed against the first body surface 1 of the body. The same rolling-in process would then take place, thereby permanently securing all attachments, including the strainer.

In the preferred embodiment shown, the rolling in process results in the second body surface 2 being located outwardly and upwardly of the first body surface 1. It is to be noted that it is possible to "roll-in" any desired attachment, including a strainer 14, so that the entire flange 18, including both the first and second body surfaces, are approximately in the same horizontal plane. In such a configuration the connecting surface 3, and the recess 4 formed therein would dip below this horizontal plane. This configuration and other slight variations on the relative locations of the two surfaces are expressly intended to fall within the scope of the claims herein.

Figure 6:
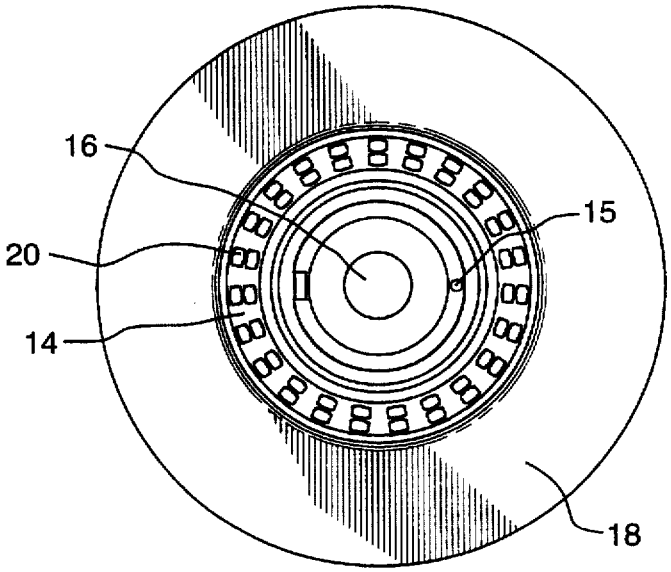
FIG. 6 is a top view of the drain.

Referring now to FIG. 6, a top view of the roof drain 10 is shown. Flange 18 extends outwardly, the outer edge forming the largest outer diameter of the drain. Strainer 14 is centrally located over the opening 6 to the tube section 11 of the drain 10. Holes 20 (which can be of various configurations) are located in strainer 14 and are approximately equally spaced around its circumference.

In the embodiment shown, strainer 14 includes both a set of upper and lower holes. Strainer cap 16 is provided in the top portion of the strainer to provide access to the first body surface 1 and the tube section 11 of the drain.

Figure 4A:
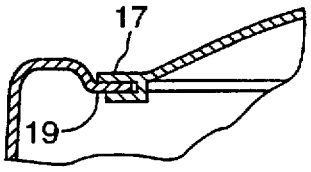
FIG. 4A is an expanded cross-sectional view of the cap and cap bracket.
Figure 4B:
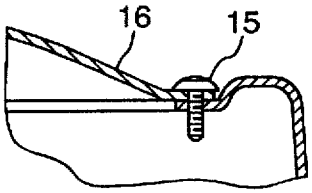
FIG. 4B is an expanded cross-sectional view of the cap and cap retaining screw.

Referring now to FIGS. 4A and 4B, the method of securing the cap 16 is shown in more detail. A cap bracket 17 is provided on one side of the cap 16 which is configured to receive a lip 19 on strainer 14. In effect this acts as a simple hinge. Cap 16 is secured to strainer with a cap retaining screw 15. This screw is of a non-standard variety such as a Torx® or an Allen Key variety so that it is not removable using the most common of hand tools.

Figure 7:
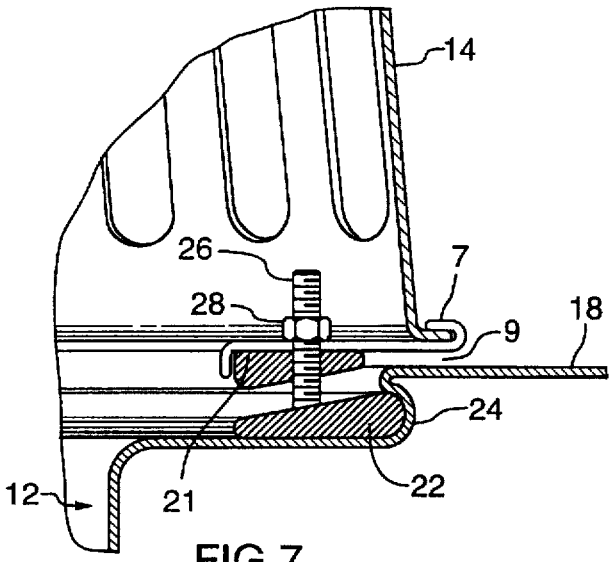
FIG. 7 is an expanded cross-sectional view of a second embodiment of the present invention showing a permanently retained clamping ring.
Figure 8:
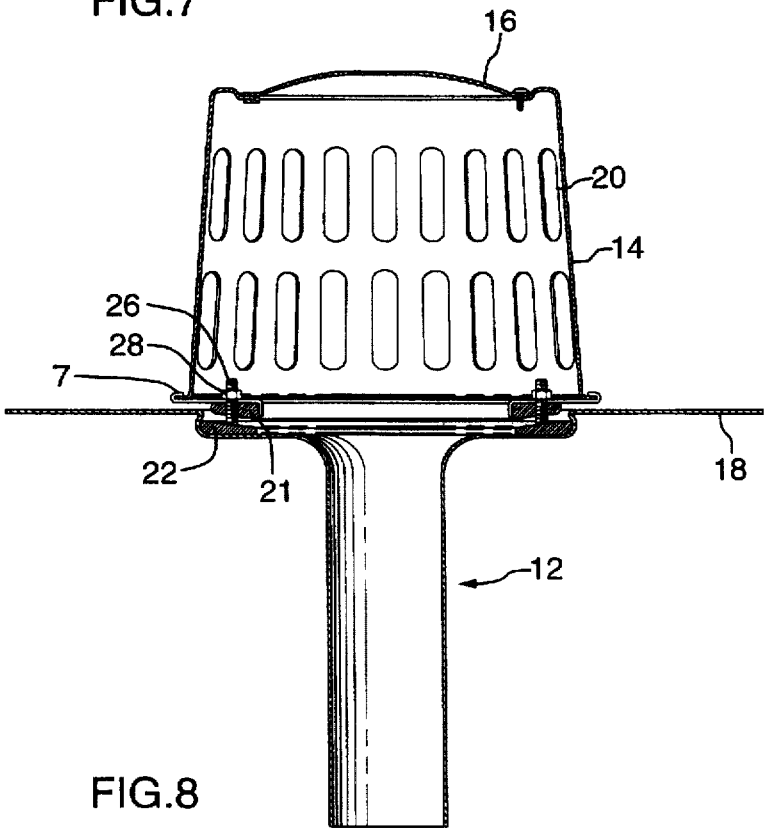
FIG. 8 is a side cross-sectional view of the second embodiment.

A second embodiment of the drain is shown in FIGS. 7 and 8. This is what is commonly referred to as the "clamping ring" model. Clamping rings are quite common in the industry and are used in applications where a higher degree of security is required in attaching a strainer or other attachment.

In this embodiment, a generally annular clamping ring is provided in two parts: an upper clamping ring 21 and a lower clamping ring 22. The strainer 14 is attached to the body 12 via the clamping ring and related accessories. The strainer is removable via a service technician, ie. it is semi-permanently secured.

The lower clamping ring 22 is again appropriately sized and configured to be located and mated against the first body surface 1 of the flange on the body. Lower clamping ring 22 is again "rolled-in" during a metal spinning process, and is thereby permanently secured to the flange 18 in the body 12. The lower clamping ring 22 includes threaded studs 26 spaced equally around its circumference. These studs are positioned to pass through holes in upper clamping ring 21 and in clamp 7. Clamp 7 attaches strainer 14 with the upper and lower portion of the clamping ring. A separate clamp is used for each stud 26.

To install the strainer 14 in the embodiment of the present invention which includes a clamping ring, the base 12, which includes the permanently affixed lower portion of the clamping ring 22, is first secured into a supporting roof structure 34. Upper clamping ring 21 is then placed over threaded studs 26. Clamp 7, which is fastened to strainer 14, is then placed over threaded studs 26 so that clamp 7 engages upper clamping ring 21. The entire assembly is then tightened using nuts 28 which are accessed through cap 16 in the top of the strainer 14. Cap 16 is then secured to the strainer using cap screw 15.

FIG. 8 depicts the completed assembly of the clamping ring embodiment showing all components in their respective positions.

It will be appreciated that the above description related to the preferred embodiment by way of example only. Many variations on the invention will be obvious to those knowledgeable in the field, and such obvious variations are within the scope of the invention as described and claimed, whether or not expressly described.

What is claimed as the invention is:

1. A roof drain which comprises:

an integrally formed body having a water collecting section, a first body surface, a second body surface and a connecting surface and at least one self-supporting body attachment, wherein;

said water collecting section is located within said body, said collecting section including a generally funnel shaped portion with said funnel shaped portion terminating into a vertically oriented cylindrical section, said cylindrical section forming the lowermost portion of said body with said cylindrical section sized and shaped for joining to a cylindrical pipe;

said first body surface being generally horizontally oriented and extending outwardly and completely surrounding said collecting section; said second body surface being generally horizontally oriented and positioned outwardly from said first body surface and completely surrounding said first body surface with said connecting surface joining said second body surface to said first body surface, said second body surface being generally parallel to said first body surface;

said connecting surface being obliquely oriented with respect to said parallel first and second horizontal body surfaces and extending outwardly from said first body surface to said second body surface;

said at least one self-supporting body attachment for mounting on top of and generally in the centre of said body, said attachment being sized and shaped so as to be capable of being located against and mating with said first horizontal body surface and when mated with said first body surface said attachment being positioned inwardly from said second body surface and inwardly from said connecting surface;

and attachment means to secure said at least one body attachment to said body, said attachment means consisting of an annular recess located in said connecting surface into which said at least one attachment is permanently secured.

2. The roof drain of claim 1, wherein said body is integrally formed from aluminum.

3. The roof drain of claim 1, wherein said body attachment is a strainer.

4. The roof drain of claim 1, wherein said second generally horizontal body surface is located outwardly and upwardly from said first generally horizontal body surface.

5. The roof drain of claim 3, wherein at least one additional body attachment is included, said at least one additional attachment being chosen from the group of: leaf guard, gravel stop, ballast collar, control flow collar.

6. The roof drain of claim 1, wherein the body attachment includes a peripheral mounting flange sized and shaped to be received into and secured by the attachment means.

7. The roof drain of claim 1, wherein the body attachment is a two-part clamping ring, having both upper and lower portions, wherein the lower portion is secured via the attachment means.

8. The roof drain of claim 7, wherein the lower portion of the clamping ring includes permanently attached threaded studs which project upwardly, said studs being used to secure at least the upper portion of the clamping ring.

* * * * *